US010758913B2

(12) United States Patent
Lauermaa

(10) Patent No.: US 10,758,913 B2
(45) Date of Patent: Sep. 1, 2020

(54) METHOD OF MAKING A LIFTER BAR, A REFURBISHED LIFTER BAR AND A MOULD

(71) Applicant: OUTOTEC (FINLAND) OY, Espoo (FI)

(72) Inventor: Kari Lauermaa, Jyvaskyla (FI)

(73) Assignee: OUTOTEC (FINLAND) OY, Espoo (FI)

( * ) Notice: Subject to any disclaimer, the term of this patent is extended or adjusted under 35 U.S.C. 154(b) by 1148 days.

(21) Appl. No.: 14/782,823

(22) PCT Filed: Apr. 14, 2014

(86) PCT No.: PCT/FI2014/050269
§ 371 (c)(1),
(2) Date: Oct. 7, 2015

(87) PCT Pub. No.: WO2014/170542
PCT Pub. Date: Oct. 23, 2014

(65) Prior Publication Data

US 2016/0067715 A1 Mar. 10, 2016

(30) Foreign Application Priority Data

Apr. 15, 2013 (FI) ..... 20135365

(51) Int. Cl.
*B02C 17/18* (2006.01)
*B02C 17/22* (2006.01)

(52) U.S. Cl.
CPC ..... *B02C 17/225* (2013.01); *B02C 17/1825* (2013.01)

(58) Field of Classification Search
CPC . B29C 39/10; B29C 45/0013; B29C 45/0001; B29C 45/14; B29C 45/14008;
(Continued)

(56) References Cited

U.S. PATENT DOCUMENTS 3,107,867 A 10/1963 Svensson et al.
3,942,727 A * 3/1976 Fahlstrom ..... B02C 21/007 241/34
(Continued)

FOREIGN PATENT DOCUMENTS

FR 2 615 412 A1 11/1988
WO WO 81/01253 A1 5/1981
(Continued)

OTHER PUBLICATIONS

Office Action issued by the Finnish Patent and Registration Office in corresponding Finnish Patent Application No. 20135365 dated Aug. 23, 2016 (5 pages).
(Continued)

*Primary Examiner* — Lawrence Averick
(74) *Attorney, Agent, or Firm* — Buchanan, Ingersoll & Rooney PC

(57) ABSTRACT

The invention relates to a method of making a lifter bar (1*a*, 1*c*) for use in a grinding mill (2), to a refurbished lifter bar (1*b*) and to a mould (3) for producing the refurbished lifter bar (1*c*). The lifter bar (1*a*, 1*c*) has a predetermined form and comprises a base member. The method comprises the steps of providing a mould (3) having an interior space (4*a*) that conforms at least partially to the predetermined form; joining the mould (3) and the base member together to form a cavity (4*b*) defined by the base member and the interior space (4*a*); and filling the cavity (4*b*) with polymer and allowing the polymer to attach to the base member to construct a lifter bar (1*a*) having the predetermined form.

8 Claims, 2 Drawing Sheets

(58) Field of Classification Search
CPC ..... B29C 45/14336; B29C 45/14418; B29C 33/3842; B29C 2045/14868; B29C 2045/14877; B29C 71/02; B29C 73/02; B29C 73/025; B02C 17/225; B02C 17/1825; B29K 2075/00; B29K 2275/00; B29K 2675/00; B29K 2875/00
USPC ..... 264/36.1, 220, 236, 259, 265, 328.18, 264/331.19
See application file for complete search history.

(56) References Cited

U.S. PATENT DOCUMENTS 4,424,938 A * 1/1984 Day ..... B02C 17/225 241/182
4,446,192 A * 5/1984 Dehlen ..... B02C 17/225 241/183
4,848,681 A * 7/1989 Eriksson ..... B02C 17/225 241/183
5,019,196 A * 5/1991 McKibben ..... B22C 5/0472 156/299
5,247,341 A * 9/1993 Kurachi ..... G01M 11/0235 356/125
5,431,351 A * 7/1995 Lejonklou ..... B02C 17/225 241/183
5,472,148 A 12/1995 Schaeffer
5,513,581 A * 5/1996 Lonardi ..... B65G 11/166 110/115
5,752,665 A * 5/1998 Wason ..... B02C 17/225 241/183
6,036,127 A 3/2000 Möller
6,189,280 B1 * 2/2001 Malmberg ..... B02C 17/225 241/183
7,887,000 B2 * 2/2011 Siitonen ..... B02C 17/1825 241/183
7,997,517 B2 * 8/2011 Melo ..... B02C 17/225 241/182
8,016,220 B2 * 9/2011 Melo ..... B02C 17/22 241/183
8,152,086 B2 * 4/2012 Moller ..... B02C 17/225 241/183
8,215,341 B2 * 7/2012 Iwai ..... B29C 33/52 138/103
8,622,330 B2 * 1/2014 Mepham ..... B02C 17/225 241/182
9,533,309 B2 * 1/2017 Watt ..... B02C 17/1825
9,717,954 B2 * 8/2017 Chen ..... B29C 43/003
2003/0062372 A1 * 4/2003 Malmberg ..... B65D 90/041 220/500
2008/0317992 A1 * 12/2008 Malmberg ..... B02C 17/225 428/44
2009/0166456 A1 * 7/2009 Hellman ..... B29C 39/006 241/179
2009/0173595 A1 * 7/2009 Burstrom ..... B65G 11/166 193/25 E
2009/0242675 A1 * 10/2009 Siitonen ..... B02C 17/1825 241/183
2011/0073694 A1 * 3/2011 Timm ..... B02C 17/225 241/182
2011/0186670 A1 8/2011 Town
2012/0112386 A1 * 5/2012 Debergh ..... B29B 7/14 264/319
2012/0181364 A1 * 7/2012 Mepham ..... B02C 17/225 241/182
2013/0299617 A1 * 11/2013 Watt ..... B02C 17/1825 241/183
2014/0178635 A1 * 6/2014 Imaizumi ..... B60J 1/007 428/138

FOREIGN PATENT DOCUMENTS

WO WO 2010/017589 A1 2/2010
WO WO 2012/012880 A1 2/2012
WO WO 2012/079123 A2 6/2012

OTHER PUBLICATIONS

International Search Report (PCT/ISA/210) dated Jul. 30, 2014, by the Finnish Patent Office as the International Searching Authority for International Application No. PCT/FI2014/050269.
International Preliminary Report on Patentability (Form PCT/IPEA/409) dated Apr. 15, 2013, by the Finnish Patent Office as the International Searching Authority for International Application No. PCT/FI2014/050269.

* cited by examiner

METHOD OF MAKING A LIFTER BAR, A REFURBISHED LIFTER BAR AND A MOULD

FIELD OF THE INVENTION

The present invention relates to a method of making a lifter bar and more particularly to a method as defined in the preamble of independent claim 1. The present invention also relates to a refurbished lifter bar as defined in the preamble of independent claim 12. The present invention also relates to a mould for producing a refurbished lifter bar as defined in the preamble of independent claim 15.

BACKGROUND OF THE INVENTION

Grinding mills are used to process hard solid material such that the solid material is crushed into smaller pieces. The grinding mills comprise a rotatable drum having a cylindrical wall and the interior of the drum is used for processing the solid material. The interior wall of the drum is equipped with lifter bars and as the drum rotates the lifter bars lift up the solid material along the inside wall of the drum to a point where gravity causes the solid material to fall down inside the drum and by falling down the solid material is crushed.

The lifter bars' function is to assist in lifting the solid material being processed up the side of the drum as it rotates. The lifter bars are typically made of rubber or elastomer so during time the lifter bars become worn and they have to be replaced by new ones. The lifter bars become worn from the wearing surface and especially from the leading face of the lifter bar, the leading face being the upstream side of the lifter bar which is at least partially facing the predetermined direction. The extent of the leading face of the lifter bar depends on the form of the lifter bar but it is the part of the lifter bar which contacts the solid material when the solid material is lifted up to the point from which it falls down. When the leading face of the lifting bar wears over time because of the continuous impact of the solid material the lifting effect becomes less and the efficiency of the grinding mill diminishes. The lifter bars may have to be replaced with new ones about every six months.

The following discussion of the prior art is intended to present the invention in an appropriate technical context and allow its significance to be properly appreciated. Unless clearly indicated to the contrary, however, reference to any prior art in the specification should not be construed as an admission that such art is widely known or forms part of the common knowledge in the field.

US 2012/0181364 A1 discloses a mill liner assembly to be mounted on a shell of a grinding mill. The mill liner assembly includes shell plates and lifter bars having a mounting portion. The publication discloses a problem that while the lifter bars and shell plates become worn they have to be replaced quickly and separately and for this purpose a new way of mounting of said assembly is developed.

One of the disadvantages associated with the above arrangement is that when the lifter bars become worn they have to be replaced with new ones and the old lifter bars are waste that has to be disposed. The replacement of lifter bars with new ones is a necessary but expensive part of maintenance of a grinding mill and the disposal of the worn lifter bars add costs on top of that. There is also an environmental aspect relating to the used lifter bars because over time the amount of waste material becomes quite considerable.

BRIEF DESCRIPTION OF THE INVENTION

An object of the present invention is thus to provide a method for producing a lifter bar so as to alleviate the above disadvantages, that is to save in costs and in waste material. The objects of the invention are achieved by a method of producing a lifter bar and a refurbished lifter bar which both are characterized by what is stated in the independent claims. The object of the invention is also achieved by a mould for producing a refurbished lifter bar. The preferred embodiments of the invention are disclosed in the dependent claims.

The invention is based on the idea of reusing the existing lifter bars and refurbishing them so as to minimize the waste material that is caused by the wear and tear of the lifter bars over time. Another aspect of the invention is that a lifter bar having a form that is not preferable to a certain grinding mill or a certain grinding process can be change with the method according to the invention.

A method of making a lifter bar which is used in a grinding mill according to the invention comprises the following steps: providing a mould having an interior space that conforms at least partially to a predetermined form of the lifter bar used in a grinding mill, joining the mould and a base member of the lifter bar together to form a cavity defined by the base member and the interior space and filling the cavity with polymer and allowing the polymer to attach to the base member to construct a lifter bar having the predetermined form. The lifter bar for use in a grinding mill and/or the lifter bar that is that is already used in a grinding mill have a predetermined form and comprise a base member.

So the base member may be a worn lifter bar or a part of the worn lifter bar or a lifter bar having a different form than the predetermined form such that a new wearing surface is moulded to the lifter bar to form a predetermined form to the lifter bar. So that the invention relates to a method of refurbishing a worn lifter bar which said lifter bar is being used in a grinding mill. The method comprises the step of providing a mould for moulding a new wearing surface to the lifter bar, arranging the mould and the lifter bar together such that an empty space between the lifter bar and the mould is formed, i.e. a cavity is formed by the mould and the lifter bar comprising a base member, said empty space conforming to a worn-away portion of an unused lifter bar. The method also comprises a step of filling the empty space in the mould, i.e. the interior space of the mould with a polymer such that the polymer is attached to the lifter bar to form a bond with the lifter bar for forming a refurbished lifter bar having a new wearing surface. In other words an embodiment of invention is the method of providing a refurbished lifter bar for use in a grinding mill comprising the steps of providing a mould for moulding the refurbished lifter bar which the mould having a cavity conforming to at least a portion of an unused lifter bar and filling the cavity of the mould with a polymer to form a refurbished lifter bar having a new wearing surface. A lifter bar to be refurbished has a first form, which the first form is either a form that results from the lifter bar being worn or a form that is a different form from what is wanted or preferred when being used in a grinding mill. So the method according to the invention is providing a mould for moulding a second form to the lifter bar, the second form being the predetermined form of the lifter bar. The mould can be arranged such that the mould and the lifter bar are arranged together such that at least part of the lifter bar is inside the mould and an empty space, i.e. a cavity, is formed between the lifter bar and the mould. After the step of arranging the mould and the lifter bar together a step of filling the empty space in the mould with polymer is performed. The empty space is filled with polymer such that polymer is attached to the lifter bar for forming a lifter bar having the second form, i.e. the predetermined form.

Another embodiment of the invention is that the base member may be a rail or a profile, preferably in aluminium, that connects the lifter bar to the grinding mill, especially to the cylindrical wall of the grinding mill, and the predetermined form of the lifter bar is moulded in connection with the base member such that a lifter bar having a predetermined form is achieved.

The method of making or refurbishing a lifter bar may further comprise an additional step of heat treating the moulded lifter bar, i.e. the lifter bar comprising a used lifter bar having a worn wearing surface attached with a moulded new wearing surface or the lifter bar comprising a base member such that the lifter bar is not worn but has another shape than the predetermined form and is attached with the moulded part to construct the lifter bar having the predetermined form. The mould for moulding a new wearing surface to the used lifter bar having a worn wearing surface is preferably made according to the unused lifter bar so that the new wearing surface of the refurbished lifter bar will be similar to an original one. The mould can be made of sheet metal because of the size of the new wearing surface that is moulded. This sheet metal made mould is less expensive compared to the casting moulds of complete lifter bars because the casting mould of complete lifter bars have to be made heavier and more robust. The at least part of the outer surface of the lifter bar is preferably prepared such that the contact surface for attaching a new wearing surface is accomplished by roughening at least part of the surface of the lifter bar and/or by treating the at least part of the surface of the lifter bar with some chemical. The mould is preferably attached to the used lifter bar such that at least part of the used lifter bar and especially the part of the used lifter bar having a worn wearing surface is arranged inside the mould. The mould can be attached to the used lifter bar for example by screws. When the mould is attached to the used lifter bar polymer is fed to fill the empty space in the mould such that said polymer adheres to the contact surface of the used lifter bar which is roughened and/or chemically treated or in some other way prepared to form a suitable contact area such that the moulded polymer and the wearing surface of the used lifter bar form a tight connection.

The step of filling the cavity with polymer and allowing it to attach to the lifter bar forms a refurbished lifter bar having a new wearing surface. The new wearing surface forms together with the base member the lifter bar having the predetermined form.

The step of treating at least part of an outer surface of the base member, i.e. a worn lifter bar or a part of the worn lifter bar or a lifter bar having a different form than the predetermined form or a rail or a profile, makes a contact surface to the base member for attaching the polymer to the lifter bar comprising the base member. The step of treating at least part of the outer surface of the base member comprises at least one of the following steps: drying the outer surface, heating the outer surface, roughening the outer surface and/or treating the outer surface with chemical. This way the outer surface of the base member may have more adhesive capacity the polymer to attach it.

The method may further comprise a step of applying a heat treatment to the lifter bar having the predetermined form. In other words the lifter bar having the predetermined form after moulding is further heat treated to improve the properties accomplished by the moulding. The polymer is preferably polyurethane and it may comprise additives, such as metal particles, ceramics or carbide.

The step of providing a mould comprises a step of forming the mould from sheet metal using an unused lifter bar as a model for the mould so that the predetermined form of the lifter bar is achieved. The step of providing a mould may also comprise a step of attaching a separate reinforced surface or separate reinforced surfaces inside the mould such that the reinforced surface is to be arranged to the surface of the lifter bar having the predetermined form. In other words the reinforced surface or surfaces are arranged inside the mould such that when the polymer is fed to the mould the reinforced surface or surfaces remain in contact with the mould such that in the moulded lifter bar having the predetermined form the reinforced surface or surfaces are on the surface of the lifter bar.

A refurbished lifter bar according to the invention comprises a lifter bar having a worn wearing surface and a new wearing surface that is attached to the worn lifter bar through moulding. The new wearing surface comprises polymer such as polyurethane. In other words the refurbished lifter bar to be used in a grinding mill comprises a worn lifter bar and a new wearing surface, said worn lifter bar and said new wearing surface being attached to each other by moulding. The refurbished lifter bar comprises a contact surface through which the worn lifter bar and the new wearing surface are bonded together to form a refurbished lifter bar. The refurbished lifter bar is moulded such that a predetermined form of the lifter bar is achieved through moulding with a mould having the predetermined form, the predetermined form being a form of an the lifter bar before it is used, in other words before it has worn.

The invention also relates to a mould for producing a refurbished lifter bar for use in a grinding mill, said mould comprising a plurality of walls for connecting the mould to a worn lifter bar and for defining a cavity in co-operation with an abraded surface of the worn lifter bar, said cavity conforming to a worn-away portion of an unused lifter bar, and an opening for admitting a polymer into said cavity. So the plurality of walls connect the mould to a base member of the lifter bar, said base member of the lifter bar being either a worn lifter bar or a part of the worn lifter bar or even a lifter bar having a different form than the predetermined form such that a new wearing surface is moulded to the lifter bar to form a predetermined form to the lifter bar. The base member may also just be a rail or a profile which connects the lifter bar to the wall of the grinding mill. The plurality of walls of the mould defines an interior space and further together with the base member of the lifter bar a cavity. The interior space conforms at least partially to a predetermined form of the refurbished lifter bar, and an opening for feeding polymer into said interior space. The mould is preferably made of sheet metal.

An advantage of the method and the refurbished lifter bar of the invention is that the need of new material for a new lifter bar is minimized because about half of the needed material can be taken from the used lifter bar and a profile for connecting the lifter bar to the grinding mill may already be arranged on the bottom of the used lifter bar which can be reused as well.

BRIEF DESCRIPTION OF THE DRAWINGS

In the following the invention will be described in greater detail by means of preferred embodiments with reference to the accompanying drawings, in which.

DETAILED DESCRIPTION OF THE INVENTION

Figure 1:
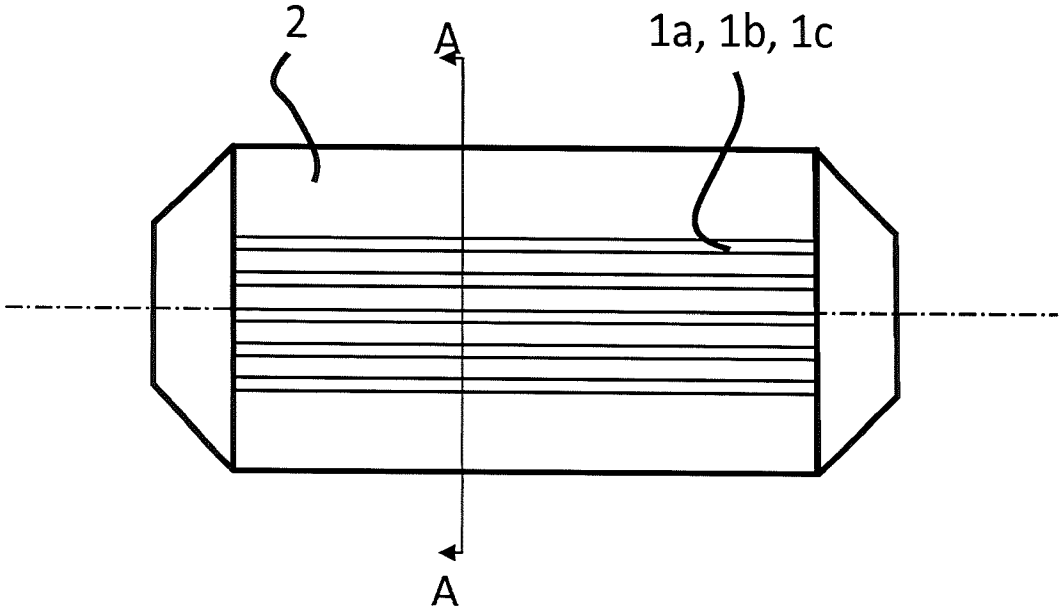
FIG. 1 shows a longitudinal cross-section of a grinding mill.

FIG. 1 shows a longitudinal cross-section of a grinding mill 2 having an inner cylindrical wall which comprises lifter bars 1*a*, 1*b*, 1*c* attached to the cylindrical wall. Shell plates, wear plates or similar elements are preferably attached to the shell of the grinding mill in between said lifter bars 1*a*, 1*b*, 1*c* such that the lifter bars 1*a*, 1*b*, 1*c* and shell plates together protect the inner surface of the grinding mill 2 and wear is subjected to them. The grinding mill 2 rotates about its central axis in the direction indicated by arrow B in FIG. 2.

Figure 2:
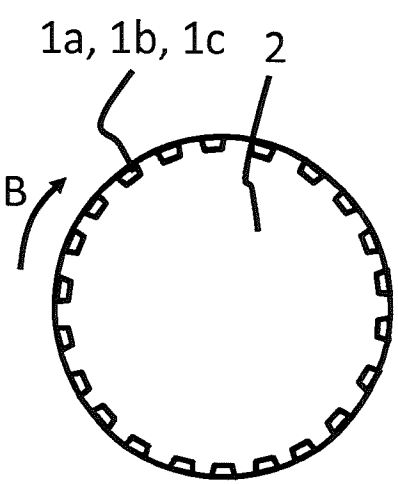
FIG. 2 is a view in cross-section of the grinding mill shown in FIG. 1 taken at line A-A.

FIG. 2 shows a view in cross-section of the grinding mill 2 shown in FIG. 1 taken at line A-A. The grinding mill 2 rotates in the direction indicated by arrow B. The lifter bars 1*a*, 1*b*, 1*c* are arranged such that they are around the cylindrical wall of the grinding mill 2. Lifter bar 1*a*, 1*b*, 1*c* comprises a rail, a profile or an insert element on the bottom of the lifter bar 1*a*, 1*b*, 1*c*. The lifter bar 1*a*, 1*b*, 1*c* is secured to the shell of the grinding mill 2 with fasteners such as bolts extending from the outer surface of the grinding mill 2 to the bottom of the lifter bar 1*a*, 1*b*, 1*c* securing the lifter bar 1*a*, 1*b*, 1*c* to the interior wall of the grinding mill 2. The rail, the profile or the insert element alone can be a base member of the lifter bar such that a predetermined form of the lifter bar 1*a*, 1*b*, 1*c* is moulded over it or the rail, the profile or the insert element can form a part of the base member such that a worn lifter bar 1*b*, a part of the worn lifter bar 1*b* or a lifter bar 1*a* having a different form than the predetermined form forms another part of the base member. The lifter bars 1*a*, 1*b*, 1*c* are typically made of rubber or elastomer and attached to the inner wall of the grinding mill 2 by bolt connection. Over time the upper and/or side surface of the lifter bar 1*a*, 1*b*, 1*c* wears and the wearing surface becomes uneven and the solid material is not lifted upwards inside the grinding mill 2 as effectively as with the new lifter bars 1*a*, 1*c*.

Figure 3:
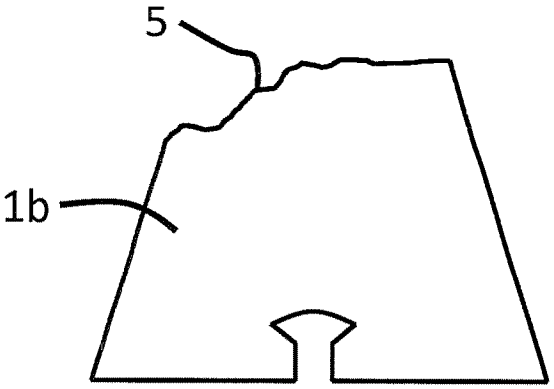
FIG. 3 shows a typical wear profile of a lifter bar.

FIG. 3 shows a typical wear profile of a worn lifter bar 1*b*. The outer surface 5 of the lifter bar 1*a*, 1*b*, 1*c* and especially the upper surface of the lifter bar 1*a*, 1*b*, 1*c* wears over time because of the impacts of the solid material that it carries and/or lifts upwards in the grinding mill 2. The upper surface comprises at least part of the top surface of the lifter bar as well as at least part of the side surface of the lifter bar which is toward the moving direction of the grinding mill 2. The outer surface 5 that wears over time is called wearing surface. As the wearing surface wears the lifting effect becomes less and the grinding mill 2 becomes ineffective and the lifter bar 1*a*, 1*b*, 1*c* has to be changed and replaced by a new lifter bar.

Figure 5:
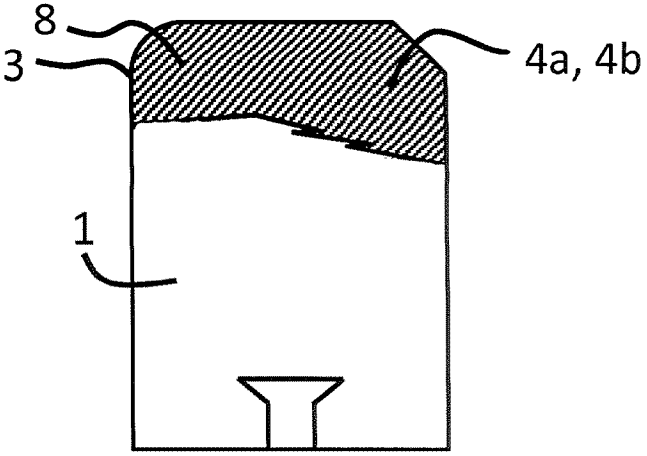
FIG. 5 shows the mould and the worn lifter bar as shown in FIG. 4 such that the mould is filled with polymer.
Figure 4:
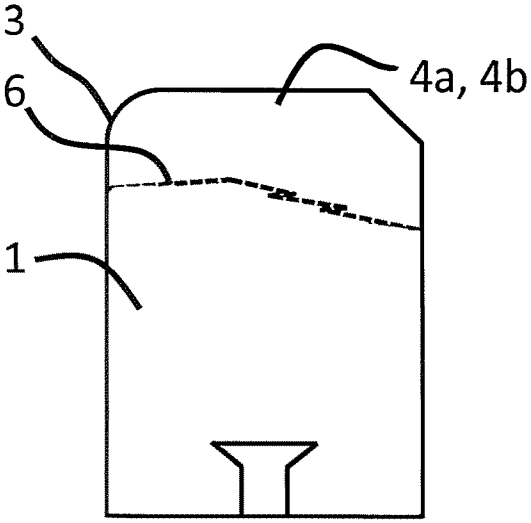
FIG. 4 shows a mould for moulding a new wearing surface to a worn lifter bar together with said worn lifter bar.

FIG. 4 shows a mould 3 for moulding a new wearing surface 8 to a worn lifter bar 1*b* and said worn lifter bar 1*b*. The mould 3 is preferably made of sheet metal by bowing such that a new unused lifter bar 1*a* is used as a model for the mould. The mould 3 can be made according to new dimensions without having an existing lifter bar 1*a* as a model. The mould comprises plurality of walls for connecting the mould 3 to the base member of the lifter bar 1*a*, 1*b*, which said plurality of walls define an interior space 4*a*. The mould also comprises an opening (not shown in figure) for feeding polymer into said interior space 4*a*. When the lifter bar 1*a* has been in use for example six months the wearing surface of the lifter bar 1*a* has worn such that the lifter bar 1*a*, 1*b*, 1*c* has to be changed for a new one. The new lifter bar 1*a* can then be made by using the mould 3 for moulding a new wearing surface to the used lifter bar 1*b*. The aluminium profile or rail of the used lifter bar 1*b* from which the lifter bar is attached to the shell of the grinding mill 2 can be used again as well as the bottom part of the worn lifter bar 1*b* and only a new wearing surface 8 is moulded. The worn lifter bar 1*b* is first treated such that the new wearing surface 8 to be moulded will form a bond with the worn lifter bar 1*b*. The worn wearing surface is preferably heat treated such there isn't any moisture in the worn wearing surface of the worn lifter bar 1*b*. The worn wearing surface may also be roughened and/or chemically treated so that the chemical bond between the worn wearing surface and the new wearing surface 8 will be created. This bond is created in the contact surface 6 between the worn lifter bar 1*b* and the new wearing surface 8. The mould 3 is then preferably attached in a conventional way to the used worn lifter bar 1*b* such that at least part of the used lifter bar 1*b* is inside the mould 3 and such that the mould 3 and the base member of the lifter bar form a cavity 4*b* for the new wearing surface 8 to be moulded. The interior space 4*a* conforms at least partially to a predetermined form of the refurbished lifter bar 1*c*. Next step is to fill the cavity 4*b* in the mould 3 with polymer such as polyurethane to form a new wearing surface 8 to the lifter bar 1*b*. This is shown in FIG. 5. Polymer can comprise ceramics and/or carbides and/or other additives to change the properties of the polymer. The polymer can also comprise metal particles. When the polymer is hardened the lifter bar having a new wearing surface 8 may be heat treated.

Figure 6:
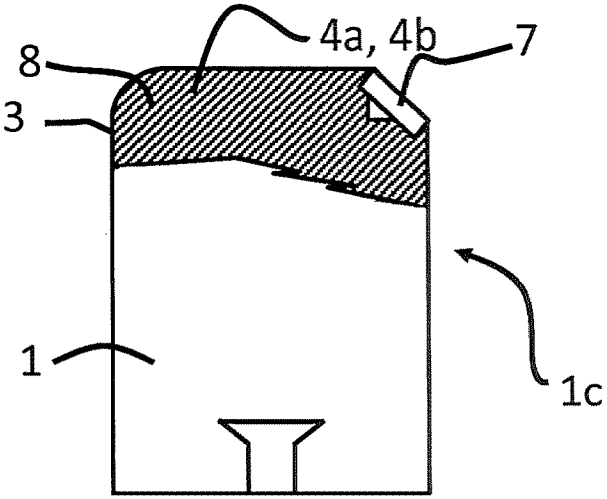
FIG. 6 shows a mould with a reinforced surface together with the worn lifter bar.

FIG. 6 shows a mould 3 with a reinforced surface 7 for moulding a new wearing surface 4 to a worn lifter bar 1 and said worn lifter bar 1. The mould 3 can additionally comprise a reinforced surface 7 to be moulded on the wearing surface 5 of the lifter bar 1. The reinforced surface 7 is for example metal piece or some other element that stays in shape longer and doesn't wear that easily. The reinforced surface 7 may be attached to the mould 3 with a screw connection such that after the polymer is hardened and the mould 3 and the screw connection is be separated from it, the reinforced surface 7 is on the surface of the new wearing surface 4. The reinforced surface 7 may comprise fin or fins which protrude from the reinforced surface 7 inside to the wearing surface 4.

The mould for producing a refurbished lifter bar for use in a grinding mill as shown in FIGS. 4 to 6 comprise a plurality of walls for connecting the mould to a worn lifter bar and for defining a cavity in co-operation with an abraded surface of the worn lifter bar, said cavity conforming to a worn-away portion of an unused lifter bar, and an opening (not shown in the figures) for admitting a polymer into said cavity.

It will be obvious to a person skilled in the art that, as the technology advances, the inventive concept can be implemented in various ways. The invention and its embodiments are not limited to the examples described above but may vary within the scope of the claims.

The invention claimed is:

1. A method of making a lifter bar having a new wearing surface for use in a grinding mill, wherein the lifter bar having a predetermined form and comprising a base member of a used lifter bar and the new wearing surface, wherein the method comprises the steps of:

providing a mould for moulding the new wearing surface to the lifter bar, the mould having an interior space that conforms at least partially to the predetermined form, the predetermined form including an outer side surface which is toward a moving direction of the grinding mill and an outer top surface which is opposite the base member;

joining the mould and the base member of the used lifter bar together such that an empty space, which is a cavity, is formed between the base member of the used lifter bar and the mould;

filling the empty space with polyurethane and allowing the polyurethane to attach to a worn wearing surface of the base member of the used lifter bar through moulding to form a moulded polyurethane wearing surface to construct the lifter bar having the moulded polyurethane wearing surface made of the polyurethane in the predetermined form such that the base member and the moulded polyurethane wearing surface form together a refurbished lifter bar having the predetermined form; and separating the mould from the moulded polyurethane wearing surface, wherein the moulded polyurethane wearing surface comprises at least part of the outer side surface of the lifter bar, which is toward the moving direction of the grinding mill, and at least part of the outer top surface of the lifter bar, which is opposite the base member.

2. A method according to claim 1, wherein the method further comprising the step of treating at least part of an outer surface of the base member such that a contact surface for attaching the polyurethane to the lifter bar is arranged.

3. A method according to claim 2, wherein the step of treating at least part of the outer surface of the base member comprises at least one of the following steps: drying the outer surface, heating the outer surface, roughening the outer surface and/or treating the outer surface with chemical.

4. A method according to claim 1, wherein the method further comprising the step of applying a heat treatment to the lifter bar having the predetermined form after moulding.

5. A method according to claim 1, wherein the polyurethane comprises additives, such as metal particles, ceramics or carbide.

6. A method according to claim 1, wherein the step of providing the mould comprises a step of forming the mould from sheet metal using an unused lifter bar as a model for the mould.

7. A method according to claim 1, wherein the step of providing the mould comprises a step of attaching a separate reinforced surface inside the mould such that the reinforced surface is to be arranged to the surface of the lifter bar having the predetermined form.

8. A method according to claim 1, wherein the base member comprises a rail or profile that connects the lifter bar to the grinding mill.

* * * * *